US010161147B2

(12) United States Patent
Jornitz

(10) Patent No.: US 10,161,147 B2
(45) Date of Patent: Dec. 25, 2018

(54) METHOD FOR CONNECTING MODULAR MOBILE ROOMS

(71) Applicant: G-CON Manufacturing Inc., College Station, TX (US)

(72) Inventor: Maik Wolfgang Jornitz, Manorville, NY (US)

(73) Assignee: G-CON MANUFACTURING INC., College Station, TX (US)

( * ) Notice: Subject to any disclaimer, the term of this patent is extended or adjusted under 35 U.S.C. 154(b) by 0 days.

(21) Appl. No.: 14/514,082

(22) Filed: Oct. 14, 2014

(65) Prior Publication Data

US 2015/0101264 A1 Apr. 16, 2015

Related U.S. Application Data

(60) Provisional application No. 61/890,516, filed on Oct. 14, 2013.

(51) Int. Cl.
*E04H 1/00* (2006.01)
*E04H 3/08* (2006.01)
(Continued)

(52) U.S. Cl.
CPC ..... *E04H 1/005* (2013.01); *E04B 1/34384* (2013.01); *E04H 3/08* (2013.01);
(Continued)

(58) Field of Classification Search
CPC . E04H 3/08; E04H 2001/1283; E04H 1/1277; E04H 5/02; F24F 2221/12;
(Continued)

(56) References Cited

U.S. PATENT DOCUMENTS 1,965,451 A * 7/1934 Brown ..... B60P 3/34 296/26.15
1,967,511 A * 7/1934 Meyer ..... 52/106
(Continued)

FOREIGN PATENT DOCUMENTS

CN 201281413 7/2009
EP 0400575 12/1990
(Continued)

OTHER PUBLICATIONS

Astra-Zeneca Pharmaceutical Building, Vanguard Modular Building Systems Brochure, Dec. 9, 2004, 2 pages.
(Continued)

*Primary Examiner* — James M Ference
(74) *Attorney, Agent, or Firm* — Edwin S. Flores; Chalker Flores, LLP

(57) ABSTRACT

A method and a connector unit for connecting two or more structures wherein at least one of the two or more structures being connected is a mobile structure validatable for pharmaceutical manufacturing or patient care. The connector unit comprises of an alignment system, a sealing, and a fixation system. The method for using the connector unit comprises of aligning the two or more structures to dock the two or more structures together, sealing the two or more structures, or one or more structures and an environment air tight with a seal or a sealing system, and affixing the two or more structures together to prevent relative movement of the two or more structures, or breakage of the seal or seal system.

15 Claims, 5 Drawing Sheets

(51) Int. Cl.

| | |
|---|---|
| ***E04B 1/343*** | (2006.01) |
| *E04H 5/02* | (2006.01) |
| *E04B 1/348* | (2006.01) |
| *E04H 1/12* | (2006.01) |

(52) U.S. Cl.
CPC ..... *E04B 1/34815* (2013.01); *E04H 1/1277* (2013.01); *E04H 5/02* (2013.01)

(58) Field of Classification Search
CPC ..... F24F 2221/36; E04B 1/34384; E04B 1/34815; E04B 1/005; E04B 1/1277
See application file for complete search history.

(56) References Cited

U.S. PATENT DOCUMENTS 2,156,859 A * 5/1939 Lowe ..... 52/106
2,247,893 A * 7/1941 Sieber ..... E04B 1/3483 52/36.2
2,480,144 A * 8/1949 Laycock ..... B63B 35/38 114/266
2,793,067 A * 5/1957 Couse ..... B60P 3/34 135/96
2,795,014 A * 6/1957 Kelly ..... E04B 1/34815 52/143
2,904,850 A * 9/1959 Couse ..... B60P 3/341 280/43.15
2,965,412 A * 12/1960 Henderson ..... B60P 3/34 296/171
3,023,463 A * 3/1962 Bigelow, Jr. ..... E04B 1/34336 52/11
3,103,709 A * 9/1963 Bolt ..... E04B 1/343 52/125.2
3,162,320 A * 12/1964 Hitch ..... B60P 1/6481 220/1.5
3,378,963 A * 4/1968 Obata ..... 52/34
3,392,497 A * 7/1968 Cushman ..... E04B 1/6183 52/241
3,495,865 A * 2/1970 Hill ..... B60P 3/0257 280/413
3,566,554 A * 3/1971 Schaffer et al. .... E04B 1/34321 52/234
3,690,077 A * 9/1972 Dalgliesh, Jr. ..... E04B 1/3404 52/309.1
3,727,753 A * 4/1973 Starr ..... E03C 1/01 206/321
3,742,932 A * 7/1973 Greenspan ..... 600/21
3,766,844 A 10/1973 Donnelly et al.
3,775,919 A * 12/1973 Fulton ..... E04B 1/34846 52/236.1
3,807,789 A * 4/1974 Turquin ..... B60P 3/32 296/168
3,832,811 A * 9/1974 Briel, Jr. ..... E04B 1/3445 52/143
3,838,880 A * 10/1974 Lefebvre ..... B60P 3/34 296/173
3,984,950 A * 10/1976 Hildebrand ..... E04B 1/34815 52/79.7
3,992,828 A * 11/1976 Ohe ..... E04B 1/3445 217/15
4,255,912 A * 3/1981 Kovacs ..... 52/79.8
4,409,889 A * 10/1983 Burleson ..... 454/187
4,599,829 A * 7/1986 DiMartino, Sr. ..... 52/79.7
4,633,626 A * 1/1987 Freeman ..... E04B 1/34315 52/126.6
4,667,579 A * 5/1987 Daw ..... 454/187
4,667,580 A * 5/1987 Wetzel ..... 454/187
4,694,736 A * 9/1987 Yamagata ..... F24F 13/20 165/57
4,707,953 A * 11/1987 Anderson ..... E04H 15/18 340/626
4,739,597 A * 4/1988 Voegeli ..... E04B 1/34315 52/223.7
4,779,514 A * 10/1988 Prigmore ..... E04B 1/3445 52/79.5
4,850,268 A 7/1989 Saito et al.
4,852,310 A * 8/1989 Henley ..... E04B 1/74 52/404.3
4,915,435 A * 4/1990 Levine ..... A61G 3/001 29/428
4,923,352 A * 5/1990 Tamura et al. ..... 414/225.01
4,970,834 A * 11/1990 Polson ..... 52/106
5,060,426 A * 10/1991 Jantzen ..... E04B 1/344 52/126.1
5,125,203 A 6/1992 Daw
5,152,814 A * 10/1992 Nelson ..... 96/224
5,191,742 A * 3/1993 Romig ..... B65D 90/24 220/1.5
5,195,922 A 3/1993 Genco
5,233,803 A * 8/1993 Bockmiller ..... E04B 2/7401 52/239
5,319,904 A * 6/1994 Pascoe ..... E04H 1/1205 52/584.1
5,344,365 A * 9/1994 Scott et al. ..... 454/187
5,353,557 A * 10/1994 Lerner et al. ..... 52/106
5,365,013 A * 11/1994 Aulson ..... B60P 3/14 144/286.5
5,412,913 A 5/1995 Daniels
5,491,934 A * 2/1996 Bigelow et al. ..... 52/79.5
5,511,594 A * 4/1996 Brennan et al. ..... 141/98
5,562,539 A * 10/1996 Hashimoto et al. ..... 454/187
5,656,491 A * 8/1997 Cassani et al. ..... 435/283.1
5,706,846 A * 1/1998 Sutton ..... A62B 13/00 135/128
5,713,791 A * 2/1998 Long ..... H01L 21/67706 454/187
5,735,639 A 4/1998 Payne et al.
5,755,479 A * 5/1998 Lavin et al. ..... 296/24.38
5,768,829 A * 6/1998 Thompson ..... E04B 1/34321 52/86
5,795,356 A * 8/1998 Leveen ..... 29/25.01
5,806,248 A * 9/1998 Kim ..... A47B 85/08 312/194
5,864,991 A * 2/1999 Burns ..... B60P 3/14 52/67
5,904,005 A * 5/1999 Dyer ..... E04B 1/3444 52/65
5,941,846 A * 8/1999 Duffy ..... A61M 5/1413 604/65
5,964,065 A * 10/1999 Migurski ..... E04H 3/08 52/64
6,155,747 A * 12/2000 Payne ..... B09B 3/00 405/129.55
6,179,358 B1 * 1/2001 Hirayama et al. ..... 296/24.38
6,250,022 B1 * 6/2001 Paz ..... E04B 1/34321 312/100
6,299,008 B1 * 10/2001 Payne ..... B65D 88/121 220/1.5
6,394,523 B1 5/2002 Yoo et al.
6,512,384 B1 1/2003 Lagowski et al.
6,568,147 B1 * 5/2003 Sumner, Sr. ..... E02D 27/02 52/169.9
6,625,937 B1 * 9/2003 Parker ..... E04B 1/3483 52/79.1
6,634,149 B2 10/2003 Cates et al.
6,849,100 B2 2/2005 Lim et al.
6,960,236 B1 11/2005 Tamura et al.
6,969,102 B2 11/2005 Orischak et al.
6,990,715 B2 * 1/2006 Liu et al. ..... 29/428
7,160,717 B2 1/2007 Everett
7,162,833 B2 1/2007 Faris
7,222,246 B2 5/2007 Pomaranski et al.
7,269,925 B2 * 9/2007 Lam ..... 52/79.1
7,272,733 B2 9/2007 Pomaranski et al.
7,272,833 B2 9/2007 Pomaranski et al.
7,326,355 B2 * 2/2008 Graetz ..... A61M 1/0236 141/10
7,472,513 B2 1/2009 Bula
7,511,960 B2 3/2009 Hillis et al.

(56) References Cited

U.S. PATENT DOCUMENTS 7,527,664 B2 * 5/2009 Jackson ..... B01D 5/0072 210/104
7,644,970 B2 * 1/2010 Chui et al. ..... 296/24.38
7,712,270 B2 5/2010 Guevremont
7,724,518 B1 * 5/2010 Carlson et al. ..... 361/679.53
7,779,586 B2 * 8/2010 Stewart et al. ..... 52/236.3
7,794,001 B2 * 9/2010 Blackwell ..... A61G 3/001 296/163
7,827,738 B2 * 11/2010 Abrams ..... E04B 1/003 52/79.1
7,861,102 B1 12/2010 Ranganathan et al.
7,934,124 B2 4/2011 Bechtolsheim et al.
7,946,644 B1 * 5/2011 Foster ..... B62D 33/042 296/186.1
7,985,382 B1 * 7/2011 Henry et al. ..... 422/291
8,042,562 B1 * 10/2011 McDaniel, Jr. ..... E04H 1/1205 135/117
8,061,080 B2 11/2011 Loebl et al.
8,065,560 B1 11/2011 Patil
8,082,699 B1 * 12/2011 Kychelhahn ..... E04B 1/6116 52/295
8,097,451 B2 * 1/2012 Gaalswyk ..... 435/289.1
8,147,301 B2 4/2012 Ghattas
8,239,340 B2 8/2012 Hanson
8,371,912 B2 * 2/2013 Ozeki ..... 454/187
8,479,038 B1 7/2013 Patil
8,584,349 B2 11/2013 Scannon et al.
8,707,630 B1 * 4/2014 Jhaveri et al. ..... 52/36.1
8,776,445 B1 * 7/2014 Jhaveri et al. ..... 52/33
8,776,446 B1 * 7/2014 Jhaveri ..... A47F 10/00 186/35
2002/0174888 A1 11/2002 Brown
2003/0024172 A1 * 2/2003 Lyons ..... E06B 5/16 52/79.1
2003/0138344 A1 * 7/2003 Mielnik et al. ..... 422/2
2003/0140555 A1 7/2003 Saether
2004/0194484 A1 * 10/2004 Zou et al. ..... 62/186
2004/0201239 A1 * 10/2004 Pellegrin, Jr. ..... 296/24.38
2004/0255449 A1 * 12/2004 Koren et al. ..... 29/430
2005/0091916 A1 5/2005 Faris
2005/0193643 A1 * 9/2005 Pettus ..... B01L 99/00 52/79.1
2005/0226794 A1 * 10/2005 Hodge et al. ..... 422/243
2005/0279035 A1 * 12/2005 Donovan ..... 52/79.1
2006/0107635 A1 5/2006 Homan et al.
2006/0150534 A1 * 7/2006 Window ..... B65D 90/0006 52/79.5
2006/0185262 A1 * 8/2006 Abler ..... E04B 1/3442 52/64
2007/0089854 A1 4/2007 Jaisinghani
2007/0130844 A1 6/2007 Arts et al.
2007/0132262 A1 6/2007 Sun et al.
2007/0167126 A1 7/2007 Ghattas
2007/0170740 A1 * 7/2007 Di Franco ..... B60P 3/34 296/26.13
2007/0228692 A1 * 10/2007 Kern ..... A61G 3/001 280/403
2007/0251145 A1 11/2007 Brusatore
2008/0047224 A1 * 2/2008 Lam ..... E04H 5/02 52/741.1
2008/0256878 A1 * 10/2008 Berns ..... E04B 1/3444 52/79.6
2008/0261220 A1 * 10/2008 Cracauer et al. ..... 435/6
2008/0302004 A1 12/2008 Lin
2009/0122533 A1 5/2009 Brukilacchio
2009/0199470 A1 8/2009 Capen et al.
2009/0217600 A1 * 9/2009 De Azambuja ..... B60P 3/34 52/79.5
2009/0249708 A1 * 10/2009 Zschornack et al. ..... 52/79.9
2009/0305626 A1 12/2009 Hope
2010/0024330 A1 * 2/2010 Sodaro ..... 52/234
2010/0024352 A1 * 2/2010 Pope ..... 52/745.02
2010/0031564 A1 2/2010 Loebl et al.
2010/0112926 A1 * 5/2010 Ozeki ..... F24F 3/161 454/187
2011/0053486 A1 * 3/2011 Holtz et al. ..... 454/187
2011/0185646 A1 * 8/2011 Kovel ..... E04B 1/00 52/79.9
2011/0232543 A1 * 9/2011 Burroughs ..... E04H 9/06 109/79
2011/0258837 A1 * 10/2011 Scannon et al. ..... 29/592
2011/0265396 A1 * 11/2011 Heather ..... B65D 90/0013 52/79.9
2012/0077429 A1 * 3/2012 Wernimont et al. ..... 454/187
2012/0099035 A1 4/2012 Burgess
2012/0181869 A1 7/2012 Chapel et al.
2013/0019913 A1 * 1/2013 Zadok ..... E04B 1/3442 135/96
2013/0109291 A1 * 5/2013 Holtz ..... B01L 1/04 454/187
2014/0179216 A1 6/2014 Walters
2016/0010883 A1 * 1/2016 Jornitz ..... E03C 1/02 454/187

FOREIGN PATENT DOCUMENTS

EP 940292 9/1999
EP 2098111 9/2009
JP 61101733 5/1986
JP 63-135736 8/1988
JP 05-106887 4/1993
JP 06-174279 6/1994
JP 06183511 7/1994
JP 10077711 3/1998
JP 2000142211 5/2000
JP 2001141274 5/2001
JP 2002-129666 5/2002
JP 2002221464 8/2002
JP 2002-332753 11/2002
JP 2004033498 2/2004
JP 2004233021 8/2004
JP 2007107779 4/2007
JP 2007107830 4/2007
JP 08-304989 12/2008
JP 2009002634 1/2009
JP 2011-185593 9/2011
KR 100675682 12/2006
TW 200912219 3/2009
WO 19961026329 A1 8/1996
WO 00/02618 1/2000
WO 03/088886 A1 10/2003
WO 03/095765 11/2003
WO 04/005170 1/2004
WO 2004/106669 A1 12/2004
WO 2007067656 6/2007
WO 08/018671 2/2008
WO 2011/022325 A2 2/2011
WO 2013132086 9/2013

OTHER PUBLICATIONS

Cleanroom Solutions, Starrco Brochure, 4 pages. Starrco Company, Inc.
HDW Series, "Hardwall Cleanroom", Abtech, Inc., p. 8.
Muth, Laboratory Design, "Modular Construction: Pros and Cons for the Lab Building," R&D Magazine, Jun. 17, 2009, 5 pages.
Pharmadule Press Release, "Pharmadule Doubles Production Capacity and Acquires Patent for Modular Biotech Plants," Sep. 27, 2002, 1 page, http://www.pharmadule.com/pharmadule-doubles-production-capacity-an . . . .
International Search Report, PCT/US2014/060505, Nov. 26, 2014.
Extended European Search Report dated Sep. 30, 2016, 8 pp.
International Search Report and Written Opinion PCT/US2015/040023 dated Jul. 10, 2015.
Moldenhauer, J., "Understanding Cleanroom Classifications," Mar. 24, 2014, http://www.cemag.us/article/2014/03/understanding-cleanroom-classifications.

(56) References Cited

OTHER PUBLICATIONS

Extended European Search Report for EP 15819080.1 dated Mar. 22, 2018, 11 pp.

* cited by examiner

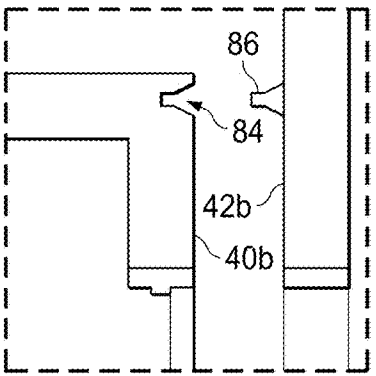
FIG. 3D
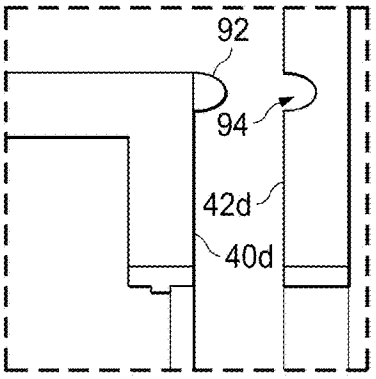
FIG. 3F
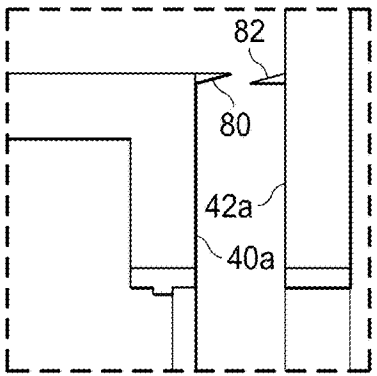
FIG. 3C
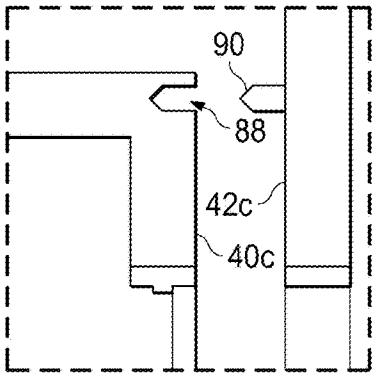
FIG. 3E
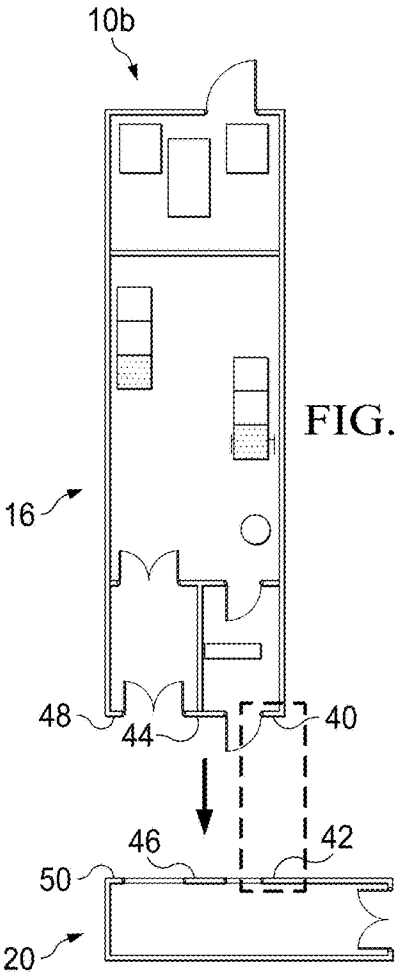
FIG. 3A
FIG. 3B

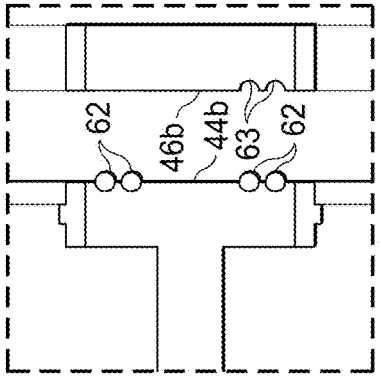
FIG. 4D
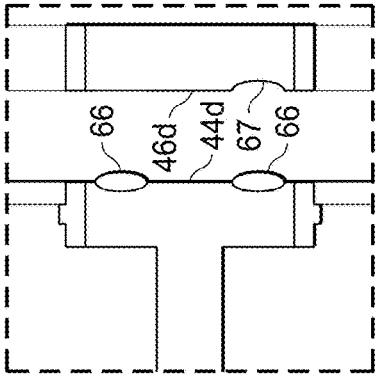
FIG. 4F
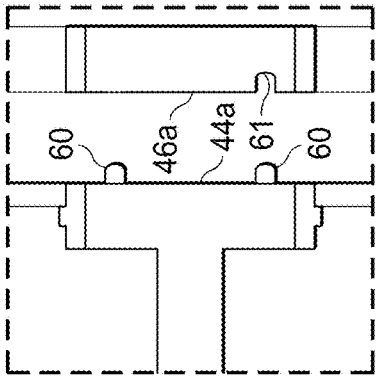
FIG. 4C
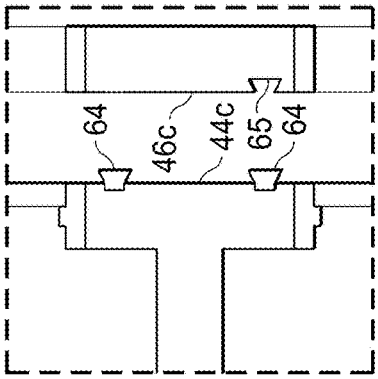
FIG. 4E
FIG. 4A
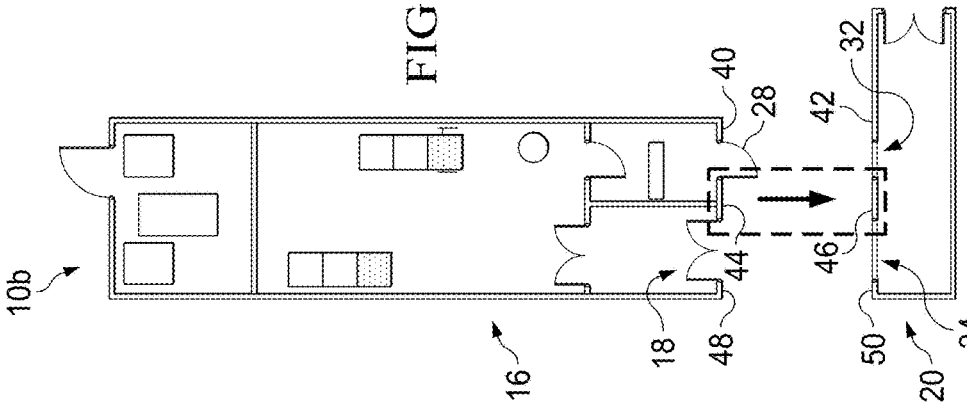
FIG. 4B

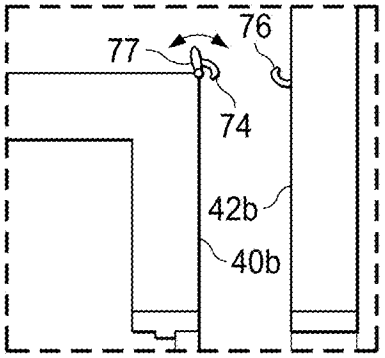
FIG. 5D
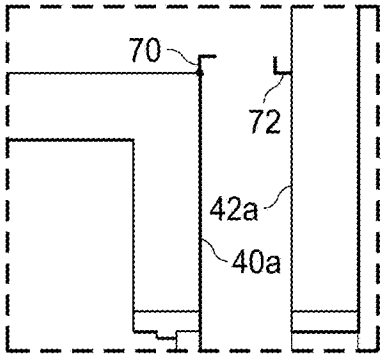
FIG. 5C
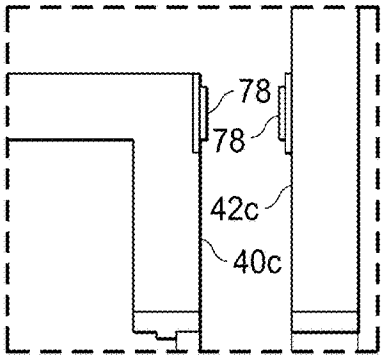
FIG. 5E
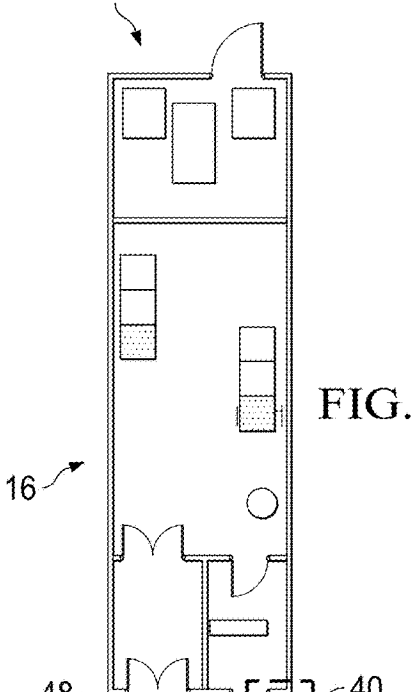
FIG. 5A
FIG. 5B

METHOD FOR CONNECTING MODULAR MOBILE ROOMS

CROSS-REFERENCE TO RELATED APPLICATIONS

This application is a non-provisional application of U.S. Provisional Patent Application Ser. No. 61/890,516 filed on Oct. 14, 2013 and entitled "Unit for Connecting Modular Mobile Rooms" the entire contents of which is incorporated herein by reference.

TECHNICAL FIELD OF THE INVENTION

The present invention relates in general to the field of mobile structure assembly, and more particularly, to connecting a mobile cleanroom to another structure.

BACKGROUND OF THE INVENTION

Without limiting the scope of the invention, its background is described in connection with cleanroom construction and use.

U.S. Pat. No. 6,634,149 B2, issued to Cates, et al teaches the configuration and assembly of components used to make up a wall system that is useful for cleanrooms. Specifically a connector block for joining perpendicularly oriented studs, and a corner stud and deflection track for connecting the top track of a wall panel to a conventional ceiling grid.

U.S. Pat. No. 5,713,791 A, issued to Long, et al., teaches a modular cleanroom conduit and the method for using it when transporting products between two cleanroom environments when traveling through a less clean environment between the cleanrooms. The conduit can be adapted and modified for various distances between two cleanrooms. Each modular section has perforated floors and filters for filtering incoming gas being circulated, and exhausting out gas and contaminates.

U.S. Pat. No. 4,667,579 A, issued to Daw, et al., teaches an industrial cleanroom structure having a plenum enclosure assembly on top of the cleanroom enclosure assembly. The plenum assembly has a top, bottom, and side covers that are sealed to prevent contamination, and a filter system through which air enters the cleanroom enclosure. The cleanroom enclosure includes fabricated wall studs attached to the plenum support structure.

U.S. Pat. No. 5,125,203 A, issued to Daw, et al., teaches a connector system to provide airtight sealing between a ceiling structure and a wall structure suitable for use in a cleanroom enclosure. The connector system includes an elongate channel member which is attached to the ceiling structure such that it forms a continuous airtight seal. An elongate cap member which is received within the elongate channel member is attached to the wall structure to form the top edge of the wall structure. Elastomeric seal members are placed between the cap member and the channel member to create an airtight seal.

SUMMARY OF THE INVENTION

In one embodiment, the present invention is a connector unit for connecting two or more structures wherein at least one of the two or more structures being connected is a mobile structure validatable for pharmaceutical manufacturing or patient care. The connection is made by the movement of the mobile structure against the other structure and the connector unit includes an alignment system that guides the mobile structure to precisely dock the two or more structures together, a seal or seal system to create an air tight seal between two or more structures, or one or more structures and an environment, and a fixation system to affix the two or more structures to prevent unintentional movements of the two or more structures, or breakage of the seal or seal system. The connector unit can be used to connect one, two, or more previously validated pharmaceutical manufacturing or patient care units. The connection between the two or more structures can be disconnected, separated, and then reattached. In another embodiment, the connector unit connects two or more structures wherein at least one of the structures includes at least one of cleanrooms, isolation cubicles, containment cubicles, pods, modules, units, buildings, corridors, hallways, mobile structures, and access structures. In another aspect, a volume of a seal between the two or more structures is equal to or greater than a volume of a groove on an opposite surface. In another aspect, the seal surrounds an opening between the two or more structures to provide a hermetic seal.

In one aspect, the alignment system of the connector unit allows two or more structures to be pushed against each other and aligned in the same movement. The alignment system is important to allow a firm sealing between the two or more structures, and to avoid any damage to the sealing. The seal or seal system of the connector unit between the structures shall be reversible, not allow any air leaks, and must be able to stay intact for a prolonged period of time. The seal or seal system between the two or more structures, or one or more structures and the environment, can include at least one of induction sealing, cap sealing, adhesive sealant, bodok seal, Bridgman seal, compression seal fitting, diaphragm seal, ferrofluidic seal, a gasket, flange gasket, o-ring, o-ring boss seal, glass-ceramic-to-metal seals, piston ring, hose coupling, hermetic seal, hydrostatic seal, hydrodynamic seal, labyrinth seal, face seal, plug, radial shaft seal, siphon trap, split mechanical seal, wiper seal, dry gas seal, and exitex seal. In yet another aspect, the fixation system which keeps the structures together and avoid unintentional movements can include at least one of clamps, spring loads, bolts, magnetic coupling, bayonet coupling, or locks. In another aspect, a volume of a seal between the two or more structures is equal to or greater than a volume of a groove on an opposite surface. In another aspect, the seal surrounds an opening between the two or more structures to provide a hermetic seal.

The present invention also includes a method for connecting two or more structures with a connector unit wherein at least one of the two or more structures being connected is a mobile structure validatable for pharmaceutical manufacturing or patient care, the method comprising aligning the two or more structures to precisely dock the two or more structures together, sealing the two or more structures, or one or more structures and an environment air tight with a seal or a sealing system, and affixing the two or more structures together solidly to prevent unintentional movements of the two or more structures, or breakage of the seal or seal system. In another aspect, a volume of a seal between the two or more structures is equal to or greater than a volume of a groove on an opposite surface. In another aspect, the seal surrounds an opening between the two or more structures to provide a hermetic seal.

BRIEF DESCRIPTION OF THE DRAWINGS

For a more complete understanding of the features and advantages of the present invention, reference is now made to the detailed description of the invention along with the accompanying figures and in which:

FIG. 3 is a top view of an alignment system for aligning a structure to a corridor. The structure is designated FIG. 3A and the corridor is designated FIG. 3B. Four separate alignment elements are designated FIG. 3C, FIG. 3D, FIG. 3E and FIG. 3F.

FIG. 4 is a top view of a sealing system for sealing a structure to a corridor. The structure is designated FIG. 4A and the corridor is designated FIG. 4B. Four separate sealing elements are designated FIG. 4C, FIG. 4D, FIG. 4E and FIG. 4F.

FIG. 5 is a top view of a fixation system for fixing a structure to a corridor. The structure is designated FIG. 5A and the corridor is designated FIG. 5B. Three separate sealing elements are designated FIG. 5C, FIG. 5D and FIG. 5E.

DETAILED DESCRIPTION OF THE INVENTION

Figures 1A, 1B:
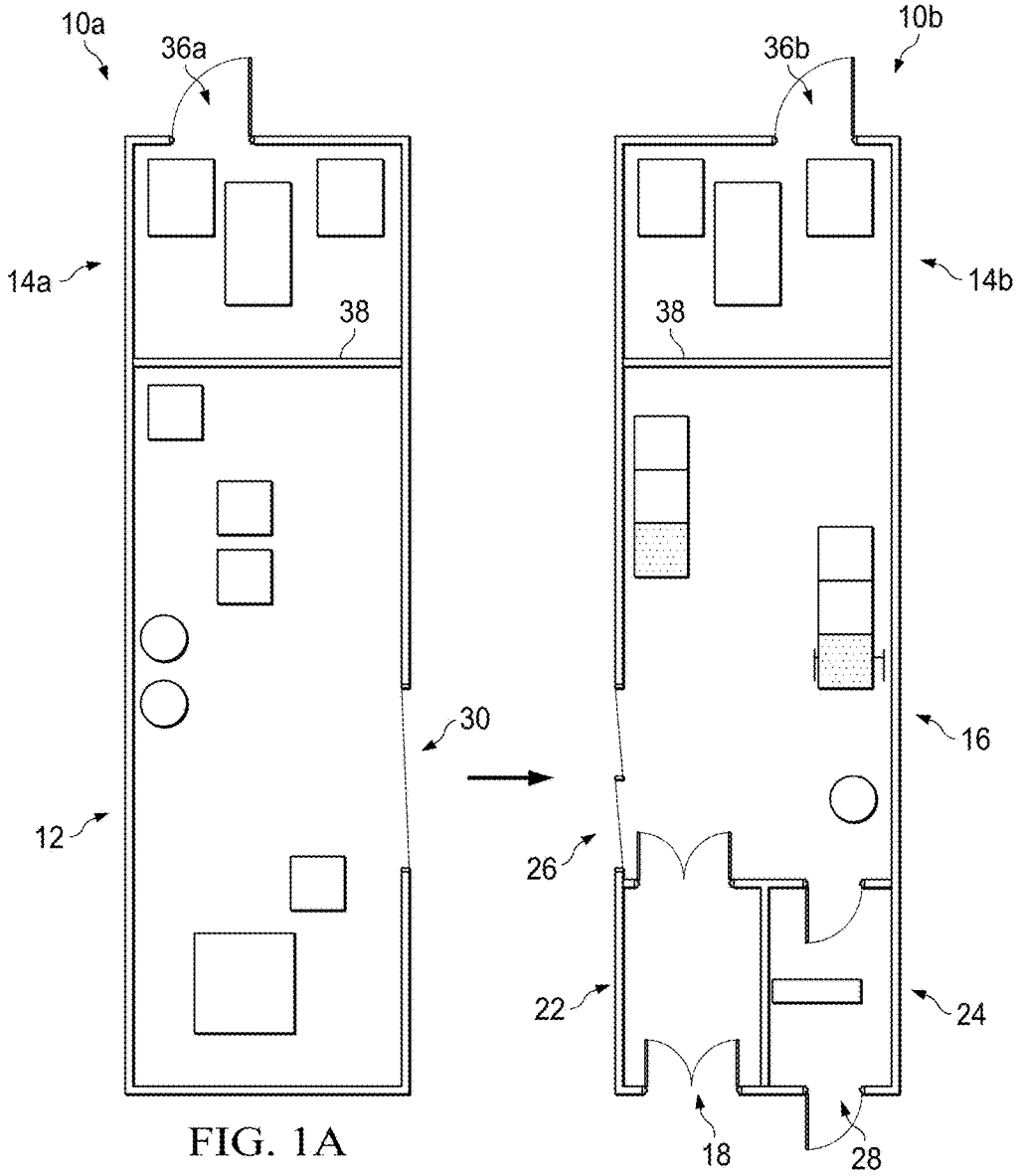
FIG. 1 is a top view of the connector unit connecting two structures. The first structure is designated FIG. 1A and the second structure is designated FIG. 1B.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not limit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The present invention is a connector unit for connecting two or more structures wherein at least one of the two or more structures being connected is a mobile structure validatable for pharmaceutical manufacturing or patient care.

The present invention can be used with a modular pharmaceutical facility for the production of, e.g., vaccines and includes all the necessary quality control, quality assurance, and lot release functions. The end product can be made within the same or an adjacent module vaccine filled in bulk vials, suitable for distribution, and compliant with all FDA current Good Manufacturing Practices (cGMP) guidelines. The following terms are used interchangeably "modular unit", "structure", "unit" or "module" to describe a unitary structure that includes at least one portion that is a sealable, working area or cleanroom in which one or more functions or processes are conducted that require a controlled working environment and a mechanical service room or area (which may be closed or open) and that support the clean room and provides redundant services to the cleanroom, e.g., air-handling, electrical, water, waste water, waste disposal, chiller and/or heated water, gas, control units and sensors, security. These services will generally be connected to a source of the service that uses universal connectors, which are those commonly used as fittings in industry (e.g., 110 or 220 volt connections, ½-1 inch liquid or gas connections, wired or wireless connections to an intra, extra or internet and the like).

As used herein, the terms "validation" and "pre-validation" are intended to encompass all documented processes or acts undertaken to demonstrate that a procedure, a process or an activity will consistently yield an expected result or outcome. Validation often includes qualification of equipment and systems. Validation is a key required component of Good Manufacturing Practices (GMP) and other regulatory requirements. For example, in the pharmaceutical industry, validation of a facility and the process within it is done prior to obtaining regulatory approval for the commercial manufacture and sale of the pharmaceutical product. Validation activities in the pharmaceutical industry may also include trial runs (pre-validation) before performing the actual validation to set validation limits, critical manufacturing controls, alert limits, etc. and to assess the potential outcome of the actual validation run. Validations routinely performed are cleaning validation, process validation, analytical method validation, computer system validation, qualifying systems and equipment including: design qualification (DQ), component qualification (CQ), installation qualification (IQ), operational qualification (OQ), and process qualification (PQ).

The skilled artisan will recognize that though the connector units, structures, facilities or units described in the instant invention are validatable, they may not be validated or required to be validated for certain uses and applications, particularly for non-human use or manufacture of products for non-human consumption (for e.g. veterinary applications, agriculture applications, pesticide manufacture, etc.).

The connector unit of the present invention can be used to form a suite or be part of multiple-modular unit facility, can include specific enclosed spaces for the manufacture, fermentation, growth (e.g., in a bioreactor) of the composition requiring an FDA approved, GMP or cGMP facility that includes, e.g., lights, controlled GMP areas consistent with USDA, CDC, FDA or regulations for foreign equivalents, including clean room conditions, purification, chromatography, bulk or individual vial filling, that can be arranged within, e.g., a standard factory or facility with a clearance sufficiently high to accommodate the units within. In one example, the modular units can be placed within a building shell that includes standard electrical connections, water, wastewater, air handling to which the units are connected. The present invention requires no pre-assembly or re-assembly of the multiple units as each can function independently and can be used for multiple purposes.

For example, a complete manufacturing facility can be built, within hours to days, from pre-assembled, pre-approved modular units that include all the equipment necessary for the desired function(s) for that unit within a manufacturing plant using the connector units of the present invention. These flexible-by-design GMP modular units allow for the design of production facilities for the rapid deployment and re-deployment of units based on the design needs. For example, one modular unit may include a self-contained bioreactor, the necessary liquid handling devices, refrigerators, tissue culture hoods and microbiology testing equipment, basic laboratory equipment (pipettors, sterile pipette tips, growth media, petri dishes, incubators and other general lab supplies), that has been tested and prevalidated to be compliant with the cGMPs or other regulatory body compliance requirements or in compliance with applicable codes, statutes, ordinances, regulations or equivalents. A modular unit for protein isolation, adjacent to but completely independent from the bioreactor unit, can be positioned and in communication with the bioreactor unit such that the materials manufactured in the bioreactor are rapidly and easily transferred to the protein isolation unit that has, pre-approved and validated protein separation units, e.g., centrifuges, liquid chromatography columns, spectrophotometers, polyacrylamide gel electrophoresis (PAGE) units and bulk packaging units. Next, the bulk protein may be transferred to a packaging unit that includes all the equipment necessary to fill individual doses of the protein, small molecule or other agent that is being manufactured.

By connecting the individual modules, the present invention provides for the rapid exchange and continuous manufacture of product in case that one part of the manufacturing process must be changed or revalidated (e.g., in the case of the manufacture of a different biological or the detection of contamination) without the need to re-certify the entire facility. The addition of more modular units, connected by the connector unit(s) of the present invention, also allows for very rapid scale-up that can be customized for short periods of time. For example, a plant can receive the addition of modular units for scaling-up for a short period of time, the manufacture and isolation of a vaccine for a short period of time and the redeployment of those units elsewhere upon completion of the production run. In fact, the present invention can be used in existing manufacturing facilities for short-term expansion of manufacturing capacity without the need for revalidation of the new manufacturing capacity or the expensive, long-term installation of an additional production line that will only be used for a short period of time.

The connector units of the present invention can be used to connect modular units to stand-alone facilities and/or module units, which may be placed within and/or outside an existing structure. One example of such a structure is an empty facility or building. One such building could be of standard, pre-cast concrete construction, flat slab with smooth floors, concrete tilt wall, double T precast ceiling and having steel or other walls. In one non-limiting example, the walls can be epoxy coated for improved cleanability). Within the building, the modular units provide the dedicated wet laboratory, growth, bioprocess and purification units necessary for manufacture. These units are simply lifted into position (e.g., pushed on air bearings, casters, pallets), connected to a power source and, if necessary, a water and/or a wastewater supply.

The present invention allows the designer to have the ability to connect one functioning modular unit to one or more additional functioning modules without disrupting the function or compliance of the original modular unit(s). Furthermore, the designer also has the ability to disconnect one functioning module from one or more additional functioning modules without disrupting the function or compliance of the original modular unit(s).

The connector units taught herein can integrate into modular units to improve energy efficiency by connecting into an efficient energy recovery system that allows for energy recapture at a rate much higher than can be expected with existing methods throughout the connector unit(s) and the modular unit(s). The intake and exhaust of the redundant HVAC systems of the connector and modular unit(s) can be connected to the central HVAC of the building thereby enhancing the energy efficiency of both units. For example, the modular units of the present invention can be placed inside of a second environment (a building with ambient temperature or less humidity), which having the modular unit interact dynamically with that second environment. In this manner of operation, the modular unit can use ambient air that does not need to be treated by a large and expensive external air handling unit.

Another vast improvement over existing designs is the ability of the modular units to service multiple clients with a single cluster of modular units in a single contiguous manner through the connector units. For example, a biotechnology research park or similar entrepreneurial facility could host various different companies, each having their own production facility or modular unit. One distinct advantage of using the modular units is that each completely selfcontained modular unit can contain an individual hazardous waste, spills, etc., without affecting any other structures (within a process flow or affecting an adjacent production facility, e.g., when a facility has various manufacturing lines or different companies).

When the modular unit needs to be connected to a source of water, the incoming water could be purified in an adjacent modular unit that could service various different production lines or the module itself could include a water purification unit. The modular unit of the present invention has the advantage that the redundant air handling units, electrical panels and even the water filtration units can be in the portion of the modular unit that is adjacent the clean room and can be serviced without service personnel having to enter the clean room area. When handling wastewater, the modular unit can include sump pumps to eliminate waste. Furthermore, the bag in/bag out filters connected to the air-handling units can also be changed without the need to enter the cleanroom area. These separate externally accessible portions of the modular units allow for maintenance and maintenance personnel to service the unit without the need to gown-up and enter the clean room area.

Duplicate processes and equipment for air handling, exhaust, etc., with automatic fault tolerance/failover allows the user, e.g., from an external panel or via the internet, to switch-over from a first system to a second system if sensors within the modular unit sense a problem with a component in the first system or as part of regular maintenance.

Another feature of the connector units of the present invention is the ability to use utility and other connection devices (e.g., plugs and fittings) that are well-known to maintenance personnel. For example, the modular units can use standard quick connectors for chilled water, electricity, etc. that allow the user to 'hot swap' the modular units externally. One advantage of the present invention is that it can take advantage of existing building infrastructure, e.g., mechanical equipment such as boilers, clean steam generator and compressors that can easily be connected to the units. The building's existing maintenance facilities and personnel can provide maintenance and service to the units and environmental service compliance from outside the clean room space via the mechanical are of the unit that is separate from the clean room space.

The connector units of the present invention can be made from, for example, a welded aluminum frame, with an all aluminum wall structure of materials and coatings that are cleanable in the drug production environment and are compliant with the cGMP's as described by the USDA, CDC, FDA or equivalent regulatory agency. Stainless steel fixtures and surfaces may also be used when necessary, but could add more weight to the unit if a weight limit exists.

The connection of the connector unit, e.g., within the clean room portion of the modular unit or even the maintenance portion of the modular unit, can be controlled and monitored externally using standard network information systems and remote systems monitoring.

Moreover, modular or connector units can be outfitted with air bearings, so that the modular units can be moved easily to other areas to be reconfigured in near real time to support necessary processes and surge capabilities without disturbing ongoing operations.

Each connector unit can be preassembled with a final documentation package that can include: the design, structural, mechanical, and electrical drawings, system dossiers, installation qualification and operational qualification plan and executed documents, maintenance logs, and pro-forma quality assurance documents including basic standard operating procedures for connecting into modular units and/or fixed facilities. These may be provided in hard copy, or provided via a display panel within the modular unit or externally (including within the maintenance bay) that is electronic and can include the necessary passcode/password protection.

Space pressure can be monitored, e.g., the pressure in the connector units and/or modular unit(s) to which they are connected. If the pressure drops to 0.0" water column (WC) or below, an alarm can be sent to the BAS. When an alarm is sent to the BAS, the system can call pre-programmed emergency telephone numbers and/or communication electronically via text or email.

Additional Points that can be monitored in the connector unit include, e.g., a static pressure blowout sensor in communication with the air handling units (AHU's) For example, the BAS can determine if there is a belt failure in either of the AHU's or EF's by using, e.g., an amp sensor that monitors the change in amp draw on the motor. Another sensor can be a pitot tube in the supply air duct and exhaust air duct that monitors static pressure connected to the BAS. Also, gravity dampers, automatic dampers and damper end switches and the controls can also be connected to and monitored by the BAS.

FIG. 1 depicts the connector unit connecting mobile modular structure 10*a* to a second mobile modular structure 10*b*. Mobile modular structure 10*a* includes two parts, a clean room 12 and a maintenance room 14*a*. Mobile modular structure 10*b* includes a clean room 16 and a maintenance room 14*b*. The maintenance room 14*a* and 14*b* are separated from the clean room 12 and 16 by a wall 38 that isolates the clean room 12 and 16 from maintenance room 14*a* and 14*b*. Maintenance room 14*a* and 14*b* each have a single point of entry 36*a* and 36*b*, through which maintenance personnel can enter mobile modular structure 10*a* and 10*b* without needing to access the clean room 12 and 16. Clean room 12 provides a single entry/exit point 30 for mobile modular structure 10*a*. Clean room 16 in mobile modular structure 10*b* includes a Material Airlock (MAL) room or area 22, which provides entry point 18, and a personnel airlock (PAL) room or area 24, which provides an exit point 28. The PAL can be a gown-in/gown-out room. Clean room 16 also has a docking bay 26, which is where entry/exit point 30 from structure 10*a* connects to using the connector unit. The mobile modular structure 10*a* and 10*b* are shown with two air-handling units and a bag-in/bag-out filtration system, e.g., a high-efficiency particulate air (HEPA) filtration system.

Figures 2A, 2B:
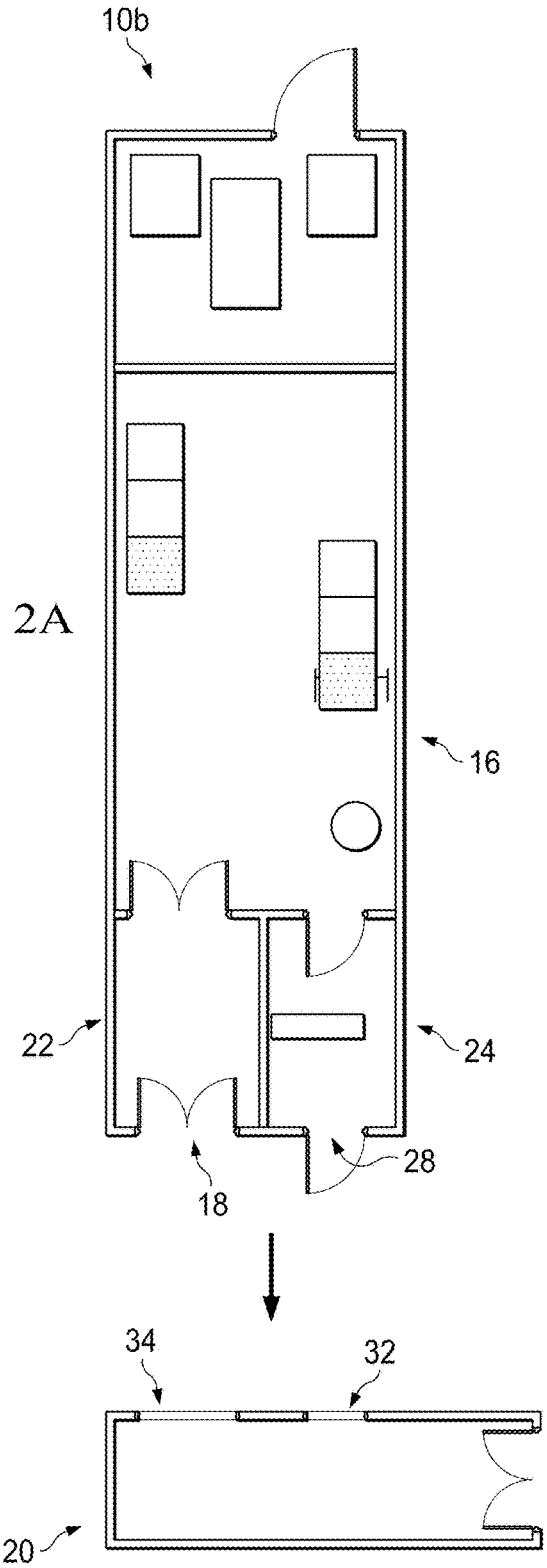
FIG. 2 is a top view of the connector unit connecting a structure to a corridor. The structure is designated FIG. 2A and the corridor is designated FIG. 2B.

FIG. 2 depicts the connector unit connecting mobile modular structure 10*b* to a corridor structure 20. Corridor structure 20 has a docking bay entry 34 which connects to entry point 18 in MAL room 22, and docking bay exit 32 which connects to exit point 28 in PAL room 24. However, the connector unit can be used to connect two or more structures wherein at least one of the structures being connected includes at least one of cleanrooms, isolation cubicles, containment cubicles, pods, modules, units, buildings, corridors, hallways, mobile structures, and access structures.

FIG. 3 depicts a closer and more detailed cross sectional top view of various embodiments of the alignment system of the connector unit, aligning mobile modular structure 10*b* to corridor structure 20. The alignment system is located between the outside wall 40 of cleanroom 16 and on the outside wall 42 of corridor structure 20, and can be positioned on any pair or any combinations of pairs of the surfaces between 40 and 42, 44 and 46, or 48 and 50 to help align and connect entry and exit 18 and 28 with docking bay entry and exit 34 and 32. The figure depicts a closer cross-sectional view of different embodiments of the alignment system between surfaces 40 and 42. One embodiment of the alignment system is a pair of protruding interlocking triangular wedges 80 and 82, with wedge 80 on outside cleanroom wall 40*a* and wedge 82 on outside corridor wall 42*a*. Another embodiment is a compressible protruding winged structure 86 on the outside corridor wall 42*b*, which compresses and fits into rectangular cutout 84 in the outside cleanroom wall 40*b*. The compression of the winged structure 86 inside the cutout 84 allows the accurate docking of the structures. Another embodiment is a protruding pointed house structure 90 on outside corridor wall 42*c* which aligns and fits into pointed house cutout 88 in outside cleanroom wall 40*c*. The pointed head on structure 90 allows for accurate and precise placement when sliding into the pointed cut out 88. Yet, another embodiment, this time with the protruding rounded half ellipse structure 92 being on the outside cleanroom wall 40*d* instead, which will align and fit into rounded half ellipse cutout 94 in outside corridor wall 42*d*. The rounded structure 92 allows for easy precise placement and docking of the modular mobile structure 10*b*. The alignment system however can be any type of cast and mold system, with a protruding cast of any shape on either outside wall 40 or 42, being used to align and fit into a complementary mold of the cast on the opposite wall. Additional multiple designs that can be used for the alignment system including a tongue and groove design, interlocking structures, dovetail joints, and crenellated joints.

FIG. 4 depicts a closer and more detailed top view and various cross-sectional embodiments of the sealing system of the connector unit connecting mobile modular structure 10*b* to corridor structure 20. The sealing system borders cleanroom 16 entry and exit points 18 and 28, and corridor structure 20 docking bay entry and exit 34 and 32, between surfaces 40 and 42, 44 and 46, and 48 and 50. A cross-sectional top view of the sealing between surfaces 44 and 46 is shown with various embodiments of the sealing.

One embodiment is a single layer, rounded rectangular seal 60 that is placed between surfaces 44*a* and 46*a*. The seal can positioned opposite of the seal 60 shown by placing the seal on surface 46*a* instead of 44*a* (not depicted). Alternatively, the seal 60 can enter a groove 61 in surface 46*a*, with the volume of the seal 60 being equal to or greater than the volume of the groove 61 in surface 46*a*. The groove 61 and seals 60 can be positioned on either surface 44*a* or 46*a*, can be alternated, and can also surround the openings between cleanroom 16 and corridor 20.

Another embodiment is a double layer, thinner rounded seal 62 on surface 44*b*, which fits into grooves 63 on surface 46*b* or can contact surface 46*b* directly. Seal 62 and grooves 63 can be positioned vice versa with the seal on surface 46*b* instead, and the grooves 63 on surface 44*b*. The groove 63 and seals 62 can be positioned on either surface 44*b* or 46*b*, can be alternated, and can also surround the openings between cleanroom 16 and corridor 20.

Another embodiment is a trapezoidal shaped seal 64 between surfaces 44*c* and 46*c* wherein the seal would be thicker against one surface (or vice versa). The seal 64 can be positioned on surface 46*c* instead of 44*c*. Likewise, the seal 64 shown herein is not limited to a specific surface, but can be on surface 46*c* with the thicker lining against surface 44*c*. As with the embodiment described above, the seal 64 can enter the grooves 65 or directly contact the surface 46*b* (or vice versa). The groove 65 and seals 64 can be positioned on either surface 44*c* or 46*c*, can be alternated, and can also surround the openings between cleanroom 16 and corridor 20.

The fourth embodiment shows a single layer wider rounded seal 66 between surface 44*d* and 46*d*. Again, The seal 66 can be on surface 46*d* instead of 44*d*. As with the embodiment described above, the seal 68 can enter the grooves 67 or directly contact the surface 46*b* (or vice versa). The groove 67 and seals 66 can be positioned on either surface 44*d* or 46*d*, can be alternated, and can also surround the openings between cleanroom 16 and corridor 20. The seal or seal system of the connector unit between the structures shall be reversible allowing the two structures to be undocked and separated when necessary. The seal system needs to not allow any air leaks, and must be able to stay intact for a prolonged period of time. There are multiple other designs available for the seal or seal system between the two or more structures, or one or more structures and the environment. The seal system designs for the connector unit can include at least one of induction sealing, cap sealing, adhesive sealant, bodok seal, Bridgman seal, compression seal fitting, diaphragm seal, ferrofluidic seal, a gasket, flange gasket, o-ring, o-ring boss seal, glass-ceramic-to-metal seals, piston ring, hose coupling, hermetic seal, hydrostatic seal, hydrodynamic seal, labyrinth seal, face seal, plug, radial shaft seal, siphon trap, split mechanical seal, wiper seal, dry gas seal, or exitex seal.

FIG. 5 depicts a closer and more detailed cross sectional, top view of various embodiments of the fixation system of the connector unit. Here, the fixation system would lock the mobile modular structure 10 and the corridor structure 20 together after the structures have been aligned and docked together. The fixation system keeps the structures together and avoids unintentional movements. The fixation system would be position on the outer edge of the mobile modular structure 10*b* between either surfaces 40 and 42, 44 and 46, 48 and 50, or any combinations of the pair of surfaces. Closer cross-sectional views of various embodiments of the fixation system are shown between surfaces 40 and 42. One embodiment of the fixation system shows a rigid swiveling hook 70 on surface 40*a* that swings onto a counter hook 72 on surface 42*a*. The hooks can be positioned vice versa with the swiveling component 72 on the outer corridor wall 42*a*, and the fixed counter hook on the outer cleanroom wall 40*a*. Another embodiment shows a rounded clip and capping system wherein a clip 74 interlocks with clip 76 and then held together by a swiveling cap 77. A third embodiment shown is the mobile modular structure 10*b* and the corridor structure 20 affixed together by magnetic couplings 78. These fixation systems do not only have to be between a single pair of surface 40 and 42, but can be between multiple pairs of surfaces including 44 and 46, or 48 and 50, or all. Multiple designs for the fixation system are available and can include at least one of clamps, spring loads, bolts, magnetic coupling, bayonet coupling, or locks.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context. In certain embodiments, the present invention may also include methods and compositions in which the transition phrase "consisting essentially of" or "consisting of" may also be used.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

REFERENCES

U.S. Pat. No. 4,667,579
U.S. Pat. No. 5,125,203
U.S. Pat. No. 5,713,791
U.S. Pat. No. 6,634,149

What is claimed is:

1. A method for connecting two structures with a connector unit, the method comprising:

obtaining a first mobile structure and a second mobile structure wherein the first mobile structure has a first wall having a first opening, and wherein the second mobile structure has a second wall having a second opening that is adapted to be connected to the first opening in the first wall of the first mobile structure;

placing the first and second mobile structures together by moving the first wall of the first mobile structure and the second wall of the second mobile structure together into contact with each other and aligning the first opening in the first wall of the first mobile structure with the second opening in the second wall of the second mobile structure in a same movement that moves the walls of the first mobile structure and second mobile structure together;

wherein the aligning is carried out by aligning a first alignment structure that is formed on the first wall of the first mobile structure and a second alignment structure that is formed on the second wall of the second mobile structure, wherein a shape of the second alignment structure is complementary to and fits a shape of the first alignment structure or wherein a shape of the first alignment structure is complementary to and fits a shape of the second alignment structure;

sealing the aligned openings between the first and second mobile structures from an environment with an air tight seal or an air tight sealing system; and affixing the first and second mobile structures together in contact with each other to prevent relative movement of the first and second mobile structures, or breakage of the air tight seal or the air tight sealing system, wherein the first and second mobile structures form a connected unit that is mobile.

2. The method of claim 1, wherein the first and second mobile structures are each selected from the group consisting of a pharmaceutical manufacturing unit, a patient care unit, a cleanroom, an isolation cubicle, a containment cubicle, a pod, a module, a unit, a building, a corridor, a hallway, a mobile structure and an access structure.

3. The method of claim 1, wherein a connection between the first and second mobile structures can be disconnected, separated, and then reattached.

4. The method of claim 1, wherein the air tight seal or air tight sealing system that seals the aligned openings between the first and second mobile structures from the environment is reversible.

5. The method of claim 1, wherein air tight seal or air tight sealing system that seals the aligned openings between the first and second mobile structures from the environment is selected from the group consisting of an induction sealing, cap sealing, adhesive sealant, bodok seal, Bridgman seal, compression seal fitting, diaphragm seal, ferrofluidic seal, a gasket, flange gasket, o-ring, o-ring boss seal, glass-ceramic-to-metal seals, piston ring, hose coupling, hermetic seal, hydrostatic seal, hydrodynamic seal, labyrinth seal, face seal, plug, radial shaft seal, siphon trap, split mechanical seal, wiper seal, dry gas seal, and exitex seal.

6. The method of claim 1, wherein the step of affixing the first and second mobile structures together comprises a method of using a device selected from the group consisting of a clamp, a spring load, a bolt, a magnetic coupling, a bayonet coupling, or a lock.

7. The method of claim 1, wherein the air tight seal or the air tight sealing system surrounds the aligned openings between the first and second mobile structures to provide a hermetic seal.

8. A method for connecting two mobile cleanroom structures with a connector unit, the method comprising:

obtaining a first mobile structure and a second mobile structure wherein the first mobile structure has a first wall having a first opening that is adapted to be connected to another opening, and wherein the second mobile structure has a second wall having a second opening that is adapted to be connected to the first opening in the first wall of the first mobile structure; and placing the first and second mobile structures together by moving the first wall of the first mobile structure and the second wall of the second mobile structure together into contact with each other and using an alignment system to align the opening of the first mobile structure and the opening of the second mobile structure together in a same movement that moves the walls of the first mobile structure and second mobile structure together;

wherein the alignment system comprises a first alignment structure that is formed on the first wall of the first mobile structure and a second alignment structure that is formed on the second wall of the second mobile structure, and wherein a shape of the second alignment structure is complementary to and fits a shape of the first alignment structure or wherein a shape of the first alignment structure is complementary to and fits a shape of the second alignment structure, wherein the first and second mobile structures form a connected unit that is mobile.

9. The method of claim 8 further comprising the steps of:

sealing the aligned openings between the first and second mobile structures from an environment with an air tight seal or an air tight sealing system; and affixing the first and second mobile structures together in contact with each other to prevent relative movement of the first and second mobile structures, or breakage of the air tight seal or the air tight sealing system.

10. The method of claim 9, wherein the first and second mobile structures are each selected from the group consisting of a pharmaceutical manufacturing unit, a patient care unit, a cleanroom, an isolation cubicle, a containment cubicle, a pod, a module, a unit, a building, a corridor, a hallway, a mobile structure, and an access structure.

11. The method of claim 9, wherein the connection between the first and second mobile structures can be disconnected, separated, and then reattached.

12. The method of claim 9, wherein the air tight seal or air tight sealing system that seals the aligned openings between the first and second mobile structures from the environment is reversible.

13. The method of claim 9, wherein air tight seal or air tight sealing system that seals the aligned openings between the first and second mobile structures from the environment is selected from the group consisting of an induction sealing, cap sealing, adhesive sealant, bodok seal, Bridgman seal, compression seal fitting, diaphragm seal, ferrofluidic seal, a gasket, flange gasket, o-ring, o-ring boss seal, glass-ceramic-to-metal seals, piston ring, hose coupling, hermetic seal, hydrostatic seal, hydrodynamic seal, labyrinth seal, face seal, plug, radial shaft seal, siphon trap, split mechanical seal, wiper seal, dry gas seal, and exitex seal.

14. The method of claim 9, wherein the step of affixing the first and second mobile structures together comprises a method of using a device selected from the group consisting of a clamp, a spring load, a bolt, a magnetic coupling, a bayonet coupling, or a lock.

15. The method of claim 9, wherein the air tight seal or the air tight sealing system surrounds the aligned openings between the first and second mobile structures to provide a hermetic seal.

* * * * *